US009120998B2

(12) United States Patent
Caballero et al.

(10) Patent No.: US 9,120,998 B2
(45) Date of Patent: Sep. 1, 2015

(54) CLEANING COMPOSITIONS COMPRISING LOW HLB 2-PROPYL HEPTYL ALCOHOL ALKOXYLATES AND ALKYL POLYGLUCOSIDES

(71) Applicant: Cognis IP Management GmbH, Düsseldorf (DE)

(72) Inventors: Eduardo Caballero, Bethlehem, PA (US); Stephen F. Gross, Souderton, PA (US); James S. Dailey, Grosse Ile, MI (US)

(73) Assignee: Cognis IP Management GmbH, Duesseldorf (DE)

( * ) Notice: Subject to any disclaimer, the term of this patent is extended or adjusted under 35 U.S.C. 154(b) by 0 days.

(21) Appl. No.: 14/170,071

(22) Filed: Jan. 31, 2014

(65) Prior Publication Data

US 2014/0221268 A1 Aug. 7, 2014

Related U.S. Application Data

(60) Provisional application No. 61/759,566, filed on Feb. 1, 2013.

(51) Int. Cl.

| | |
|---|---|
| ***C11D 1/72*** | (2006.01) |
| ***C11D 1/825*** | (2006.01) |
| ***C11D 3/22*** | (2006.01) |
| ***B08B 3/04*** | (2006.01) |
| ***C11D 1/66*** | (2006.01) |

(52) U.S. Cl.
CPC *C11D 3/22* (2013.01); *C11D 1/662* (2013.01); *C11D 1/72* (2013.01)

(58) Field of Classification Search
CPC ..... B08B 3/04; C11D 1/72; C11D 1/825; C11D 3/22
USPC ..... 510/421, 470, 474; 134/25.2, 25.3, 39, 134/42
See application file for complete search history.

(56) References Cited

U.S. PATENT DOCUMENTS

| | | | | |
|---|---|---|---|---|
| 5,770,549 | A | 6/1998 | Gross | |
| 2007/0042925 | A1* | 2/2007 | Company et al. | 510/421 |
| 2011/0277786 | A1* | 11/2011 | Zhu | 134/6 |
| 2011/0294899 | A1* | 12/2011 | Lang et al. | 514/674 |
| 2013/0225471 | A1* | 8/2013 | Taneja et al. | 510/389 |

FOREIGN PATENT DOCUMENTS

| | | | | |
|---|---|---|---|---|
| WO | WO 2006/072780 | * | 7/2006 | C23G 1/12 |
| WO | WO2012/080197 | | 6/2012 | |

OTHER PUBLICATIONS

Lutensol XP Surfactants Product Sheet, *BASF* Sep. 2005, 11 pages.
Lutensol XL Surfactants Product Sheet, *BASF* Sep. 2005, 9 pages.
Griffin, William C., Calculation of HLB Values of Non-Ionic Surfactants, *J. Soc. Cosmet. Chem.*, vol. 5, No. 4 1954, 249-256.
Griffin, William C., Classification of Surface-Active Agents by "HLB", *J. Soc. Cosmet. Chem.*, vol. 1, No. 5 1949, 311-326.
Lutensol XL Types—Technical Information, *BASF* May 2003, 10 pages.

* cited by examiner

*Primary Examiner* — Brian P Mruk
(74) *Attorney, Agent, or Firm* — Servilla Whitney LLC

(57) ABSTRACT

Provided herein are cleaning compositions that are particle-free. The compositions comprises a solution containing one or more alkyl polyglucosides and one or more 2-propylheptanol alkoxylates, wherein the one or more 2-propylheptanol alkoxylates have a relatively low hydrophilic-lipophilic balance value. Also provided are methods of making and using same.

19 Claims, 7 Drawing Sheets

CLEANING COMPOSITIONS COMPRISING LOW HLB 2-PROPYL HEPTYL ALCOHOL ALKOXYLATES AND ALKYL POLYGLUCOSIDES

CROSS-REFERENCE PARAGRAPH

This application claims the benefit of priority under 35 U.S.C. §119(e) to U.S. Provisional Application No. 61/759,566, filed Feb. 1, 2013, the entire contents of which are herein incorporated by reference.

TECHNICAL FIELD

The invention generally relates to compositions suitable for cleaning applications, and specifically to compositions containing 2-propyl heptyl alcohol alkoxylates and alkyl polyglucosides having low HLB values for cleaning hard surfaces.

BACKGROUND

There are a wide variety of available cleaning compositions for hard surfaces, for example all-purpose cleaners, kitchen cleaners or bath cleaners, dishwashing compositions. There is an ongoing need for improved cleaning compositions that can remove more soil than previously possible. One method to increase detergency is to incorporate harsh inorganic builders such as sodium or potassium hydroxide. However, these compounds can be corrosive and can cause injury to the user if used improperly. Another method to increase detergency is to incorporate solvents such as low molecular weight alcohols (such as ethanol or isopropanol), which are flammable, or alkoxylated derivatives of diols (such as diethylene glycol monobutyl ether), which can be toxic. Another method to increase detergency is to increase the amount of surfactant used in the cleaning formulation which can add cost. Accordingly, there is a need for cleaning compositions that address one or more of the issues described while offering high levels of detergency, also referred to as soil removal.

SUMMARY

One aspect of the invention relates to a cleaning composition comprising a solution containing one or more alkyl polyglucosides and one or more 2-propylheptanol alkoxylates, wherein the one or more 2-propylheptanol alkoxylates have a hydrophilic-lipophilic balance value that is less than or equal to about 10.5, wherein the cleaning composition is particle-free. In one or more embodiments, the hydrophilic-lipophilic balance value is less than or equal to about 9 or less than or equal to about 8. In some embodiments, the one or more alkyl polyglucosides have an alkyl chain length of 8 to 13 carbon atoms or 9 to 11 carbon atoms.

In one or more embodiments, the alkoxylate is ethoxylate. In some embodiments, the one or more 2-propylheptanol alkoxylates comprise the reaction products of about 1 mole 2-propylheptanol with about 4 moles ethoxylate. In other embodiments, the one or more 2-propylheptanol alkoxylates comprise the reaction products of about 1 mole 2-propylheptanol with about 3 moles ethoxylate.

The cleaning composition can further comprise additives as desired. That is, the cleaning composition may, in some embodiments, further comprise an additive selected from one or more of a fragrance, a colorant, a foaming agent, an alkaline inorganic builder, a chelating agent, a solvent, a thickener, water, an anionic or cationic or amphoteric polymers, a reducing or oxidizing agent, a hydrotrope, a preservative, a co-surfactant, an inorganic acid, an organic acid, a carbonate, a bicarbonate, a citrate and a gluconate.

In some embodiments, the alkyl polyglucoside and 2-propylheptanol alkoxylates are present in a 1:1 weight ratio. In one or more embodiments, the composition is effective to remove at least 30% more soil than the average of either of the 2-propylheptanol alkoxylates comprising the reaction products of about 1 mole 2-propylheptanol with about 4 moles ethoxylate or the one or more alkyl polyglucosides alone.

A second aspect of the invention relates to a method of producing a cleaning composition, the method comprising adding one or more alkyl polyglucosides to one or more 2-propylheptanol alkoxylates to form the cleaning composition, wherein the one or more 2-propylheptanol alkoxylates have a hydrophilic-lipophilic balance value of less than or equal to about 10.5 to a cleaning composition base, wherein the cleaning composition is particle-free. In one or more embodiments, the hydrophilic-lipophilic balance value is less than or equal to about 9. In some embodiments, the hydrophilic-lipophilic balance value is less than or equal to about 9.

In one or more embodiments, the one or more alkyl polyglucosides have an alkyl chain length of 8 to 13 carbon atoms. In some embodiments, the one or more alkyl polyglucosides have an alkyl chain length of 9 to 11 carbon atoms. In one or more embodiments, the alkoxylate is ethoxylate. In some embodiments, the one or more 2-propylheptanol alkoxylates comprise the reaction product of 1 mole 2-propylheptanol with about 3 or about 4 moles ethoxylate. In one or more embodiments, the alkyl polyglucoside and 2-propylheptanol alkoxylates are present in a 1:1 weight ratio.

A third aspect of the invention relates to a method of cleaning a hard surface. The method comprises contacting a hard surface with a cleaning composition comprising a solution containing one or more alkyl polyglucosides and one or more 2-propylheptanol alkoxylates, wherein the one or more alkyl polyglucosides and one or more 2-propylheptanol alkoxylates have a hydrophilic-lipophilic balance value of less than or equal to about 10.5. In one or more embodiments, the alkyl polyglucoside and 2-propylheptanol alkoxylates are present in a 1:1 weight ratio.

BRIEF DESCRIPTION OF THE DRAWINGS

So that the manner in which the above recited features of the invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
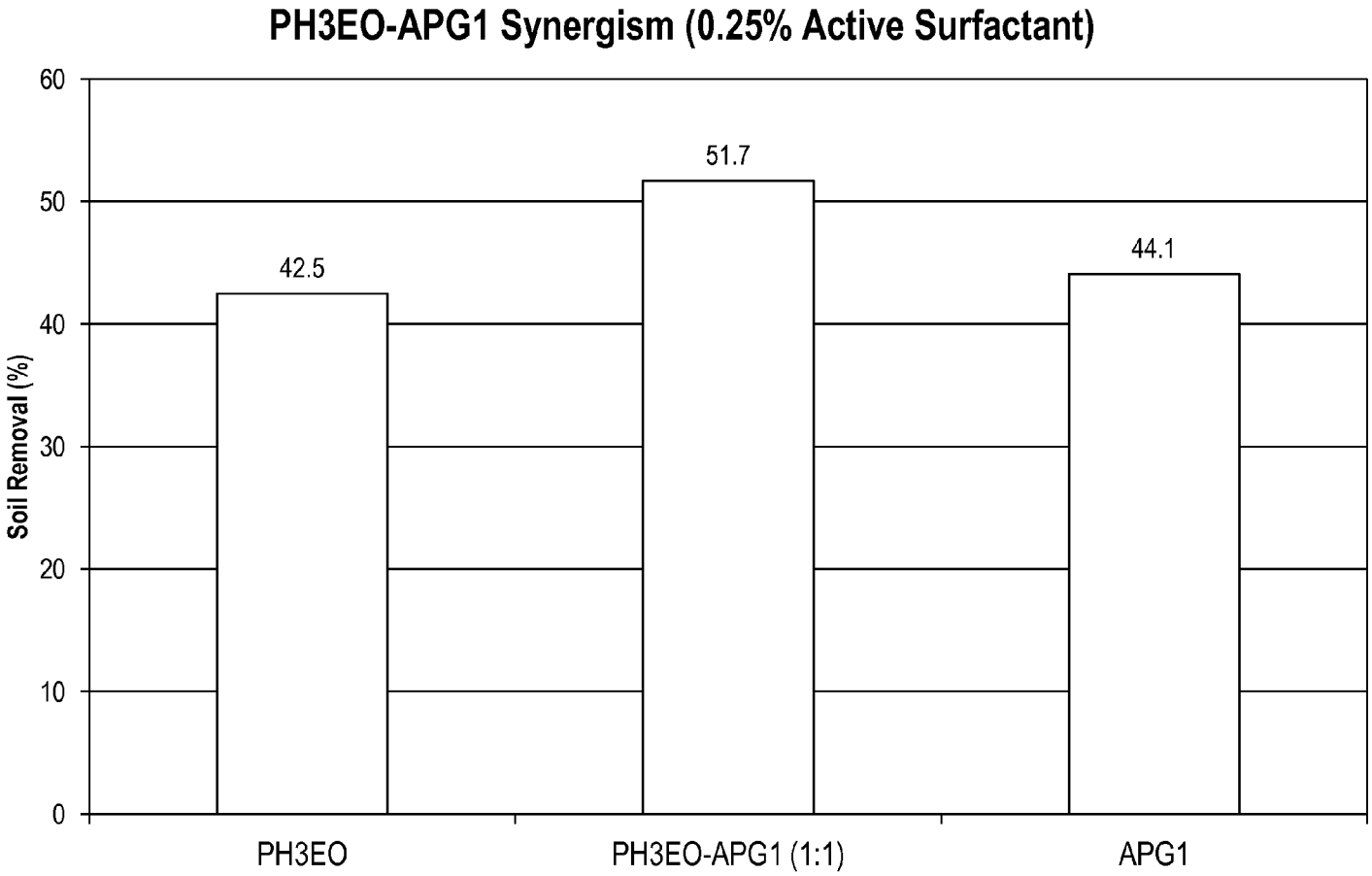
FIG. 1 is a bar graph comparing a cleaning composition according to one or more embodiments of the invention to two comparative cleaning compositions.

Before describing several exemplary embodiments of the invention, it is to be understood that the invention is not limited to the details of construction or process steps set forth in the following description. The invention is capable of other embodiments and of being practiced or being carried out in various ways.

One or more aspects provide improved hard surface cleaning compositions containing a unique mixture of surfactants. The compositions of one or more embodiments contain a low HLB, 2-propylheptanol (2-PH) alkoxylate (also referred to as 2-propylheptyl alkoxylate) and an alkyl polyglucoside (APG). That is, in preferred embodiments, the C10 alcohol alkoxylate is branched, having a C7 backbone and a C3 branch located at the second carbon. It has been surprisingly found that such compositions are synergistic in that they can remove a greater amount of soil than either component used individually. Moreover, such synergism does not exist with either mixtures of higher HLB derivatives of 2-PH alkoxylates and APGs or with mixtures of low HLB derivatives of linear alkoxylates and APGs of similar chain length.

Accordingly, one aspect of the invention relates to a cleaning composition comprising a solution containing one or more alkyl polyglucosides and one or more 2-propylheptanol alkoxylates. In one or more embodiments, the one or more 2-propylheptanol alkoxylates have a low hydrophilic-lipophilic balance (HLB) value. By "low HLB value" it is meant that the HLB value in the range of 3-10 or so. In one or more embodiments, the cleaning compositions are clear isotropic mixtures. As used herein, "solution" or refers to a solution that does not contain any particles of any size. That is, in one or more embodiments, the solution is particulate-free. In one or more embodiments, the solution is clear.

The cleaning composition may further comprise additives, but overall the cleaning composition is particle-free. In one or more embodiments, the overall cleaning composition may contain one or more of an additive selected from a fragrance; a colorant; a foaming agent; alkaline inorganic builders such as the potassium or sodium salts of silicates, ortho-, pyro- and/or polyphosphates, hydroxides such as sodium, potassium or ammonium; alkanolamines, alkylamines; chelating agents such as MGDA, EDTA, NTA, HEDTA, etc.; solvents such as, but not limited to, alcohols, glycols, glycol ethers, hydrocarbons, methyl fatty esters, dimethyl alkyl amides, dimethyl lactamides, terpenes, polyalkoxylates; fragrance oils; water; thickeners, anionic, cationic, and/or amphoteric polymers of either synthetic or natural origins; enzymes; mild reducing or oxidizing agents; hydrotropes; preservatives; co-surfactants such as anionic, cationic, amphoteric surfactants as well as nonionic surfactants that do not include APGs or 2-propylheptanol alkoxylates with HLB<11.0, inorganic/organic acids; carbonates and bicarbonates as inorganic builders; citrates and gluconates as organic builders.

The alkoxylate can be any suitable alkoxylate, provided that the resulting HLB value remains low. In some embodiments, the alkoxy group has 2 to 5 carbon atoms. In one or more embodiments, the alkoxylate comprises one or more of ethoxy groups, propoxy groups, butyleneoxy groups, pentoxy groups and combinations thereof. In further embodiments, butylene oxide groups may include 1,2 butylene oxide, 2,3 butylene oxide and/or isobutylene oxide groups. In some embodiments, the alkoxylate comprises 1,2-decene oxide. Examples of suitable low HLB 2-propylheptyl alkoxylates include, but are not limited to, Lutensol® XP30 (HLB~8), Lutensol® XP40 (HLB~9), Lutensol® XL40 (HLB~7).

Any degree of alkoxylation can be utilized as long as the resulting HLB value is kept low. Reference to alkoxylation means that an alkoxy group (referred to as "$(AO)_n$") has been added to a base molecule, here AO represents an ethylene oxide ("EO"), an propylene oxide ("PO"), an butylene oxide unit ("BO"), or their mixtures, and n stands for an integer in the range of about 1 to about 100. In a detailed embodiment, AO comprises individual or mixtures of ethylene and propylene units, either randomized or blockwise. Accordingly, in one or more embodiments, the degree of alkoxylation of the 2-propylheptyl alkoxylate ranges from about 2 to about 6 (or about 3 to about 5, or about 4). Accordingly, in one or more embodiments, the one or more 2-propylheptanol alkoxylates comprise the reaction products of about 1 mole 2-propylheptanol with about 4 moles ethoxylate. In one or more embodiments, the one or more 2-propylheptanol alkoxylates comprise the reaction products of about 1 mole 2-propylheptanol with about 3 moles ethoxylate.

The hydrophilic-lipophilic balance value of the 2-propylheptanol alkoxylate plays a role in the cleaning ability of the mixture. The HLB value, a dimensionless number between 1 and 20 according to the Griffin scale, shows whether there is preferential water or oil solubility. The HLB value describes the equilibrium of the size and strength of the hydrophilic and of the lipophilic groups of an emulsifier. Numbers under 9 tend to characterize oil-soluble, hydrophobic emulsifiers, while numbers over 11 tend to characterize water-soluble, hydrophilic emulsifiers. See The Griffin scale is described in W. C. Griffin, J. Soc. Cosmet. Chem. 1 (1949) 311; W. C. Griffin, J. Soc. Cosmet. Chem. 5 (1954) 249.

The HLB value of an emulsifier can also be calculated from increments, wherein the HLB-increments for the various hydrophilic and hydrophobic groups that make up a molecule can be found from published tables (e.g. H. P. Fiedler, Lexikon der Hilfsstoffe für Pharmazie, Kosmetik and angrenzende Gebiete [Dictionary of excipients for pharmacy, cosmetics and related areas], Edition Cantor Verlag, Aulendorf, 4th Ed., 1996) or the manufacturer's data.

The HLB value for ethoxylated products may also be calculated to the following formula: HLB=(100-L): 5, where L is the percentage by weight of lipophilic groups, i.e. fatty alkyl or fatty acyl groups, in percent by weight in the ethylene oxide adducts.

As discussed above, cleaning compositions containing mixtures of low HLB derivatives of 2-propylheptanol alkoxylates and alkyl polyglucosides have improved soil removal properties versus either component alone Importantly, this cleaning synergism does not exist with higher HLB derivatives of 2-propylheptanol alkoxylates and alkyl polyglucosides or with low HLB derivates of linear alkyl alcohol ethoxylates and alkyl polyglucosides of chain length similar to 2-propylheptanol. Accordingly, in one or more embodiments of the invention, the HLB value of the 2-propylheptanol alkoxylates is less than or equal to about 10.5. In further embodiments, the HLB value is less than or equal to about 10, 9.5, 9, 8.5, 8, 7.5, 7, 6.5, 6, or even lower. In some embodiments, the HLB value is at least 6.

Alkyl polyglucosides are glucose ethers wherein the anomeric alcohol group is replaced by an alkyl group. In one or more embodiments, the alkyl chain has a length in the range of about 7 to about 13 carbon atoms (or 8-11, or 9-12, or even 10-11 carbon atoms). In one or more embodiments, the alkyl chain length is characterized by an average carbon chain length. Accordingly, in one or more embodiments, the average alkyl chain length is in the range of about 8.9 to about 12.8. In one or more embodiments, the degree of polymerization ("DP") of the alkyl polyglucoside ranges from about 1 to about 2. In further embodiments, the DP ranges from about 1.5 to about 1.8. Alkyl polyglucosides are commercially available from BASF Corporation as Glucopon®, Plantapon®, Plantacare® and Mazon® products.

The alkylpolyglucoside and 2-propylheptanol alkoxylates can be present in varying ratios. In one or more embodiments, the alkylpolyglucoside and 2-propylheptanol alkoxylates are present in a weight ratio of about 2:1 to 1:2. In one or more embodiments, they are present in a 1:1 weight ratio.

Another aspect of the invention relates to a method of producing a cleaning composition. The method comprises adding one or more alkyl polyglucosides to one or more 2-propylheptanol alkoxylates, wherein the one or more 2-propylheptanol alkoxylates have a low hydrophilic-lipophilic balance value to a cleaning composition base.

Any of the variants in the cleaning composition described herein are applicable to the above method. For example, in one or more embodiments of the method, the hydrophilic-lipophilic balance value is about 10 or less (or 9 or less, or 8 or less, or 7 or less, or even 6 or less). In some embodiments, the one or more alkyl polyglucosides have an alkyl chain length of 8 to 13 carbon atoms or 9 to 11 carbon atoms. In one or more embodiments, the alkoxylate is ethoxylate. In some embodiments, the one or more 2-propylheptanol alkoxylates comprise the reaction product of 1 mole 2-propylheptanol with 4 moles ethoxylate. In some other embodiments, the one or more 2-propylheptanol alkoxylates comprise the reaction product of 1 mole 2-propylheptanol with 3 moles ethoxylate. In one or more embodiments, the alkyl polyglucoside and 2-propylheptanol alkoxylates are present in a 1:1 weight ratio.

Yet another aspect of the invention relates to a method of cleaning a hard surface comprising using one or more of the cleaning compositions described herein. Again, any of the variants described above can utilized. For example, in one or more embodiments, the method comprises contacting a hard surface with a cleaning composition comprising a solution containing one or more alkyl polyglucosides and one or more 2-propylheptanol alkoxylates, wherein the one or more alkyl polyglucosides and one or more 2-propylheptanol alkoxylates have a hydrophilic-lipophilic balance value of about 10 or less. In some embodiments, the alkyl polyglucoside and 2-propylheptanol alkoxylates are present in a 1:1 weight ratio.

EXAMPLES

Example 1

Synergism of Mixture Over Individual Components

Three cleaning compositions were produced and tested for soil removal. The first composition comprised 0.25 weight % of a 1:1 mixture of 2-propylheptyl alcohol ethoxylated with 3 moles EO with a blend of C9-11 alkyl polyglucosides having an average degree of polymerization ("DP") of 1.5, referred to as "PH3EO-APG1 (1:1)." PH3EO has an HLB value of 8. No other ingredients were used in the cleaning compositions. The second composition was a cleaning composition comprising 0.25 weight % of a mixture of C9-11 alkyl polyglucosides with an average degree of polymerization ("DP") of 1.5, referred to as "APG1." The APG1 composition is considered a comparative example because it does not contain alkoxylated 2-propylheptanol. The third composition was a cleaning composition comprising 0.25 weight % of 2-propylheptyl alcohol-3 moles EO, referred to as "PH3EO." The PH3EO composition is considered to be comparative because it does not contain an alkyl polyglucoside.

The three samples were tested for their ability to clean a soil composition of polar/non-polar soils and a combination of soils. First, the reflectance of unsoiled 3" by 3" vinyl composite panels was measured. A test soil was then applied to each panel. The test soil contained 50 parts Stoddard solvent, 10 parts mineral oil, 4 parts vegetable oil, 4.5 parts carbon black and 10 parts black charm clay. For each sample, 0.4 ml of the test soil was applied to the rough side of a panel. The soil was spread using a nylon brush, with the "grain" on the panel. The panels were then dried for 20 minutes at room temperature, then for an additional 20 minutes at 105° C., and then a final 20 minutes at room temperature. The reflectance of the soiled panels was measured.

Each panel was then placed into a wash tray. 200 ml of each cleaning solution was then added, and the panel was let to stand for one minute. Each test panel was then scrubbed with a synthetic sponge for 10 cycles. The panels were then rinsed with distilled water and let to dry at room temperature for an hour. The cleaning operation was repeated three times. The reflectance of the washed panels was measured.

To evaluate the cleaning ability of each sample, the percentage of soil removal (% soil removal) was calculated to be equal to $(Rw-RS)/(Ru-RS)\times 100$, where Rw is the reflectance of the washed panel, Rs is the reflectance of the soiled panel and Ru is the reflectance of the unsoiled panel.

The results of the soil removal are shown in FIG. 1. PH3EO on its own exhibited 42.5% soil removal, while APG1 exhibited 44.1%. In contrast, the PH3EO-APG1 (1:1) exhibited 51.7% soil removal, which is 7.6% above the alkyl polyglucoside alone, and 9.2% above the ethoxylated 2-propyl heptyl alcohol. This corresponds to a 19% improvement of the mixture over the average soil removal percentage of the individual components alone. The dramatic increase in soil removal of the mixture over the two components individually demonstrates the synergism of the mixture.

Example 2

Synergism of Mixture Over Individual Components

Figure 2:
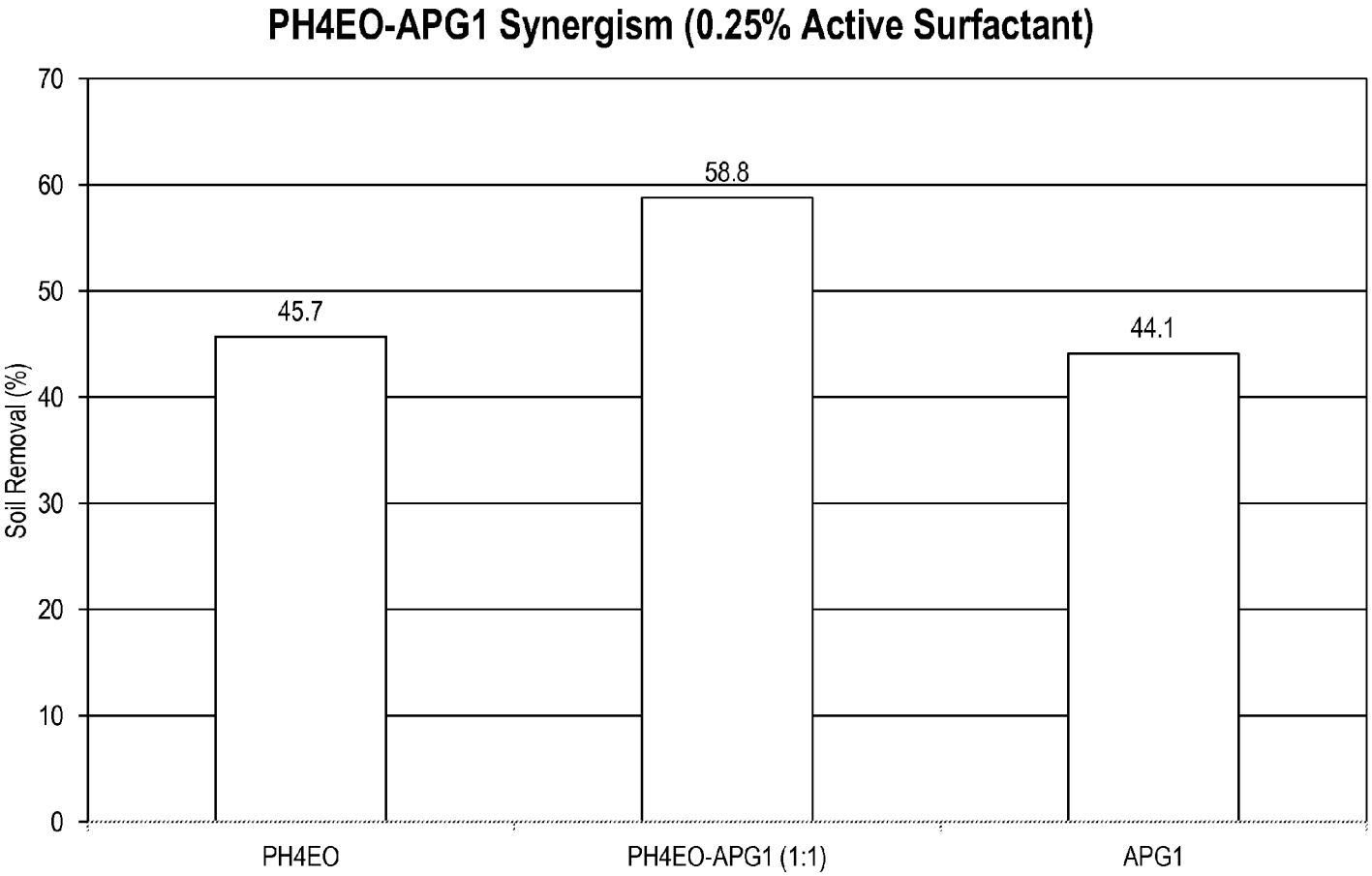
FIG. 2 is a bar graph comparing a cleaning composition according to one or more embodiments of the invention to two comparative cleaning compositions.

Three cleaning compositions were produced and tested for soil removal. The first composition was a cleaning composition comprising 0.25 weight % of a 1:1 mixture of 2-propylheptyl alcohol ethoxylated with 4 moles EO with a blend of C9-11 alkyl polyglucosides having an average DP of 1.5, referred to as "PH4EO-APG1 (1:1)." PH4EO has an HLB value of 9. The second composition was the same cleaning composition comprising 0.25 weight % of a mixture of $C_{9-11}$ alkyl polyglucosides from Example 1, again referred to as "APG1." This APG1 composition is considered a comparative example because it does not contain alkoxylated 2-propylheptanol. The third composition was a cleaning composition comprising 0.25 weight % of 2-propylheptyl alcohol-4 moles EO, referred to as "PH4EO." The PH4EO composition is considered to be comparative because it does not contain an alkyl polyglucoside. The compositions were tested for soil removal according to the same procedures in Example 1. The results of the soil removal are shown in FIG. 2. PH4EO on its own exhibited 45.7% soil removal, while APG1 exhibited 44.1%. In contrast, the PH4EO-APG1 (1:1) exhibited 58.8% soil removal, which is 14.7% above the alkyl polyglucoside alone, and 13.1% above the ethoxylated 2-propyl heptyl alcohol. This corresponds to a 30% improvement of the mixture over the average soil removal percentage of the individual components alone. The dramatic increase in soil removal of the mixture over the two components individually demonstrates the synergism of the mixture.

Example 3

Less Synergism with Higher HLB Value

Figure 3:
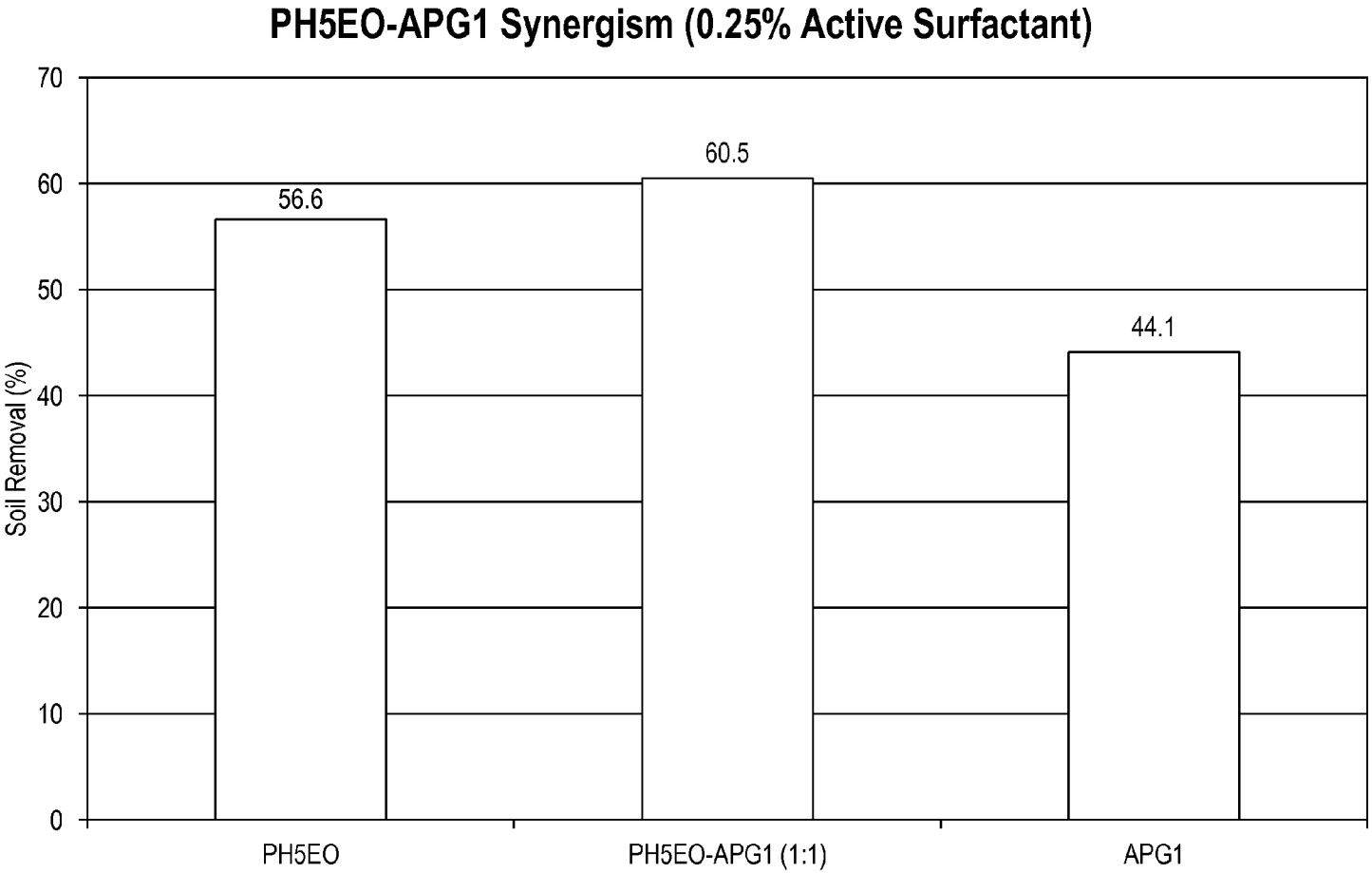
FIG. 3 is a bar graph comparing a cleaning composition according to one or more embodiments of the invention to two comparative cleaning compositions.

Three cleaning compositions were produced and tested for soil removal. The first composition was a cleaning composition comprising 0.25 weight % of a 1:1 mixture of 2-propylheptyl alcohol ethoxylated with 5 moles EO with a blend of C9-11 alkyl polyglucosides having an average DP of 1.5, referred to as "PH5EO-APG1 (1:1)." PH5EO has an HLB value of 10. The second composition was the same cleaning composition comprising 0.25 weight % of a mixture of $C_{9-11}$ alkyl polyglucosides from Example 1, again referred to as "APG1." The APG1 composition is considered a comparative example because it does not contain alkoxylated 2-propylheptanol. The third composition was a cleaning composition comprising 0.25 weight % of 2-propylheptyl alcohol-5 moles EO, referred to as "PH5EO," and is considered to be comparative because it does not contain an alkyl polyglucoside. The compositions were tested for soil removal according to the same procedures in Example 1. The results of the soil removal are shown in FIG. 3. PH5EO on its own exhibited 56.6% soil removal, while APG1 exhibited 44.1%. In contrast, the PH5EO-APG1 (1:1) exhibited 60.5% soil removal, which is 16.4% above the alkyl polyglucoside alone, and 3.9% above the ethoxylated 2-propyl heptyl alcohol. This corresponds to a 20% improvement of the mixture over the average soil removal percentage of the two individual components alone. The dramatic increase in soil removal of the mixture over the two components individually demonstrates the synergism of the mixture.

Example 4

Lack of Synergism with High HLB Value (Comparative)

Figure 4:
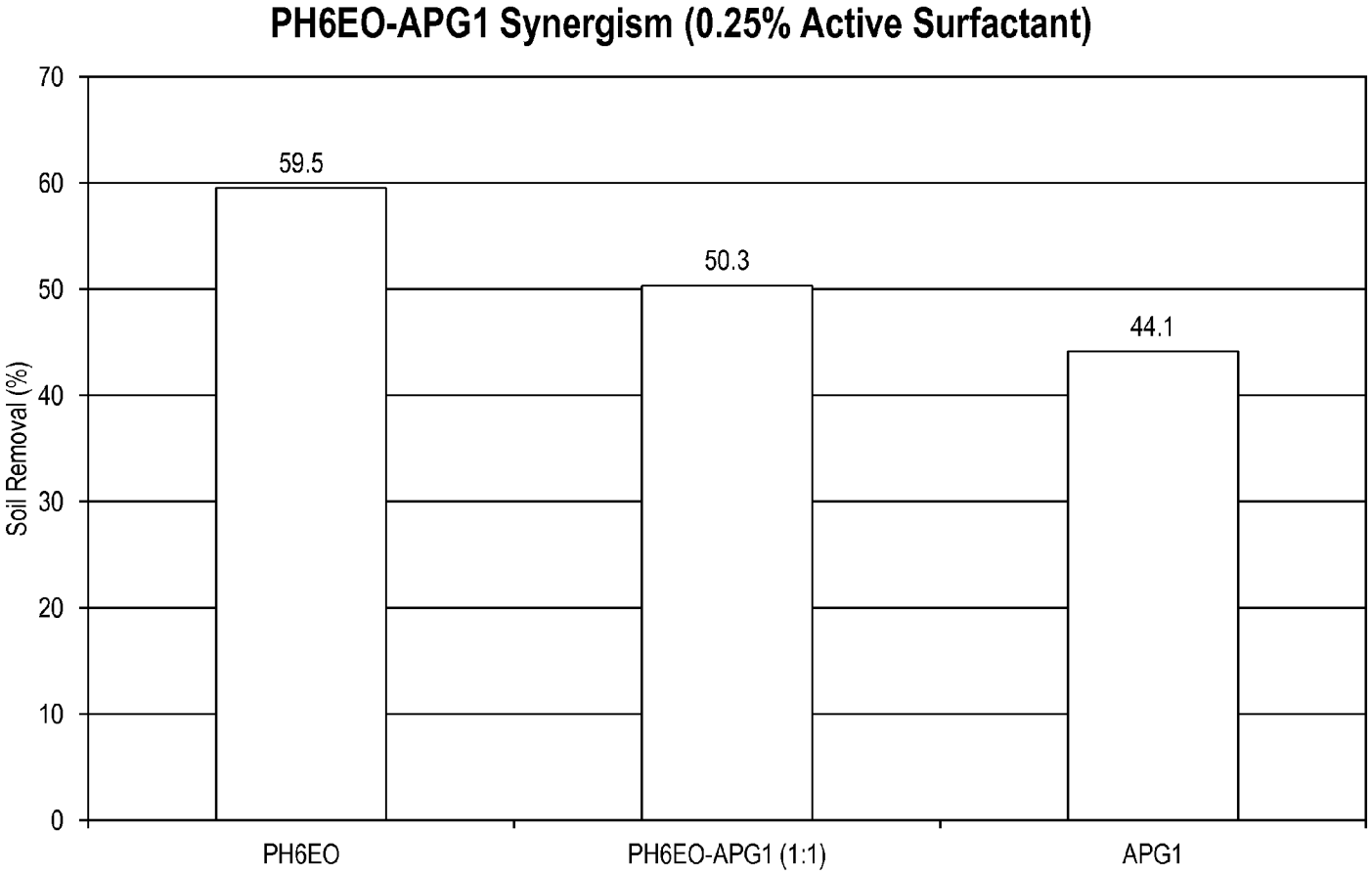
FIG. 4 is a bar graph showing an absence of synergism in three comparative examples.

Three cleaning compositions were produced and tested for soil removal. The first composition was a cleaning composition comprising 0.25 weight % of a 1:1 mixture of 2-propylheptyl alcohol ethoxylated with 6 moles EO with a blend of C9-11 alkyl polyglucosides having an average DP of 1.5, referred to as "PH6EO-APG1 (1:1)." PH6EO has an HLB value of 11. This composition is considered to be comparative because the HLB value of the PH6EO in the mixture is 11. The second composition was the cleaning composition comprising 0.25 weight % of a mixture of $C_{9-11}$ alkyl polyglucosides from Example 1, again referred to as "APG1." The APG1 composition is considered a comparative example because it does not contain alkoxylated 2-propylheptanol. The third composition was a cleaning composition comprising 0.25 weight % of 2-propylheptyl alcohol-6 moles EO, referred to as "PH6EO," and is considered to be comparative because it does not contain an alkyl polyglucoside and because the HLB value of PH6EO is 11. The compositions were tested for soil removal according to the same procedures in Example 1. The results of the soil removal are shown in FIG. 4. PH6EO on its own exhibited 59.5% soil removal, while APG1 exhibited 44.1%. The PH6EO-APG1 (1:1) mixture exhibited only 50.3% soil removal, which is 6.2% above the alkyl polyglucoside alone, but 9.2% below the ethoxylated 2-propyl heptyl alcohol. Unlike the previous three examples, the mixture did not exhibit synergism over both components individually, which demonstrates that the synergism is not present when high HLB values are used.

Example 5

Lack of Synergism with High HLB Value (Comparative)

Figure 5:
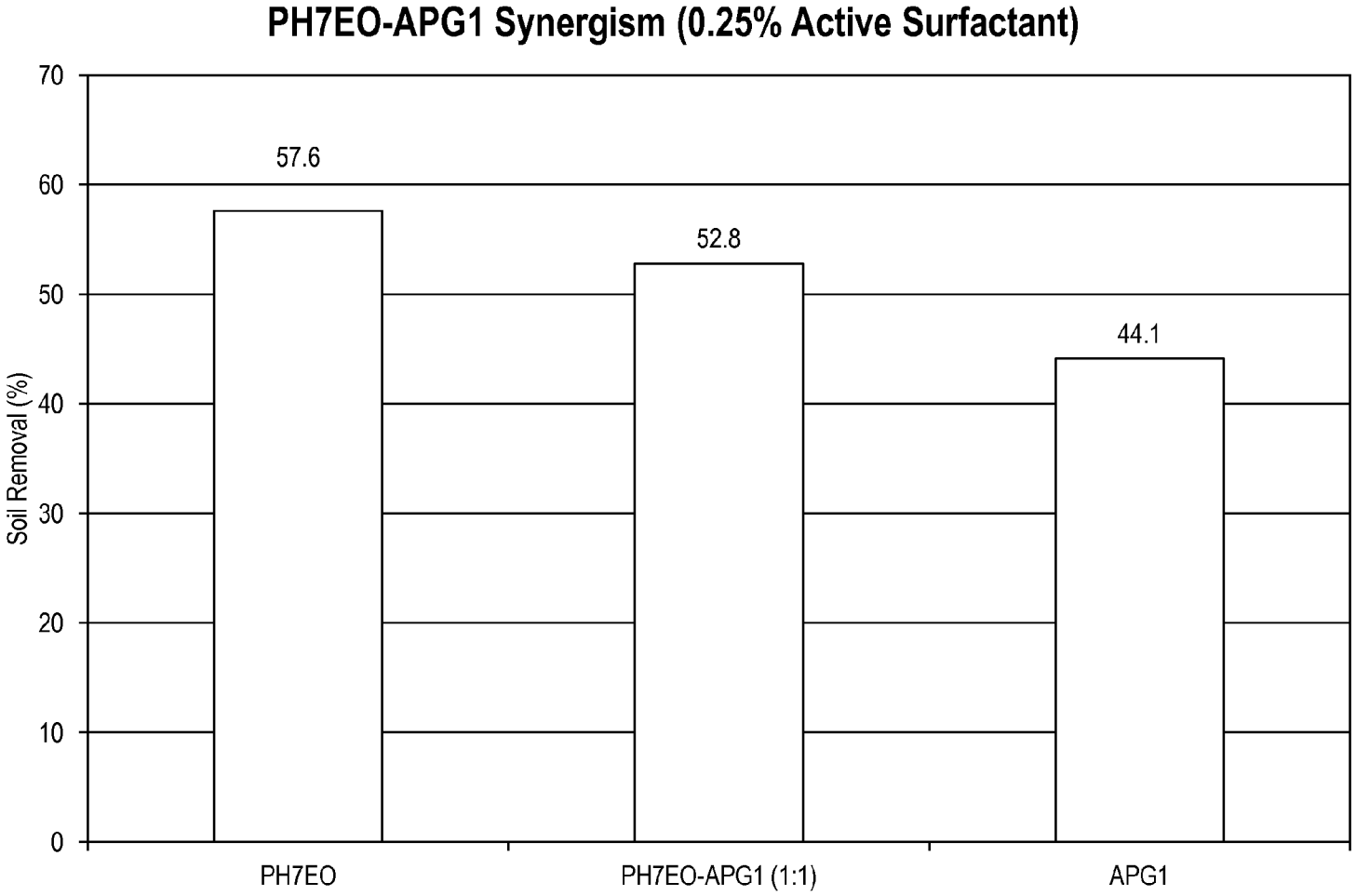
FIG. 5 is a bar graph showing an absence of synergism in three comparative examples.

Three cleaning compositions were produced and tested for soil removal. The first composition was a cleaning composition comprising 0.25 weight % of a 1:1 mixture of 2-propylheptyl alcohol ethoxylated with 7 moles EO with a blend of C9-11 alkyl polyglucosides having an average DP of 1.5, referred to as "PH7EO-APG1 (1:1)." PH7EO has an HLB value of 12. This composition is considered to be comparative because the HLB value of the PH7EO in the mixture is 12. The second composition was the cleaning composition comprising 0.25 weight % of a mixture of $C_{9-11}$ alkyl polyglucosides from Example 1, again referred to as "APG1." This composition is considered a comparative example because it does not contain alkoxylated 2-propylheptanol. The third composition was a cleaning composition comprising 0.25 weight % of 2-propylheptyl alcohol-7 moles EO, referred to as "PH7EO." This composition is considered to be comparative because it does not contain an alkyl polyglucoside and because the HLB value of PH6EO is 12. The compositions were tested for soil removal according to the same procedures in Example 1. The results of the soil removal are shown in FIG. 5. PH7EO on its own exhibited 57.6% soil removal, while APG1 exhibited 44.1%. The PH7EO-APG1 (1:1) mixture exhibited only 52.8% soil removal, which is 8.7% above the alkyl polyglucoside alone, but 4.8% below the ethoxylated 2-propyl heptyl alcohol. The mixture did not exhibit synergism over both components individually, which, like Example 4, demonstrates that the synergism is not present when high HLB values are used.

Example 6

Synergism with Alkyl Polyglucosides of Varying Alkyl Chain Lengths

Seven cleaning compositions were prepared and tested for soil removal ability. All compositions contained 0.25 weight % active surfactant, and mixtures of surfactants were in a 1:1 weight ratio. The cleaning compositions were selected as follows in Table 1:

TABLE 1

| | 2-Propylheptyl Component | Alkyl Polyglucoside Component |
|---|---|---|
| PH4EO (Comparative) | 2-propylheptyl alcohol ethoxylated with 4 moles EO | None |
| PH4EO-APG2 (1:1) | | a mixture of C8-10 alkyl polyglucosides with avg. DP 1.7 |
| PH4EO-APG3 (1:1) | | a mixture of C8-10 alkyl polyglucosides with avg. DP 1.6 |
| PH4EO-APG1 (1:1) | | a mixture of $C_{9-11}$ alkyl polyglucosides with avg. DP 1.5 |

TABLE 1-continued

| | 2-Propylheptyl Component | Alkyl Polyglucoside Component |
|---|---|---|
| PH4EO-APG4 (1:1) | | a mixture of C8-16 alkyl polyglucosides with avg. DP 1.6 |
| PH4EO-APG5 (1:1) | | a mixture of C12-16 alkyl polyglucosides with avg. DP 1.5 |
| APG1 (Comparative) | None | a mixture of C9-11 alkyl polyglucosides with avg. DP 1.5 |

Figure 6:
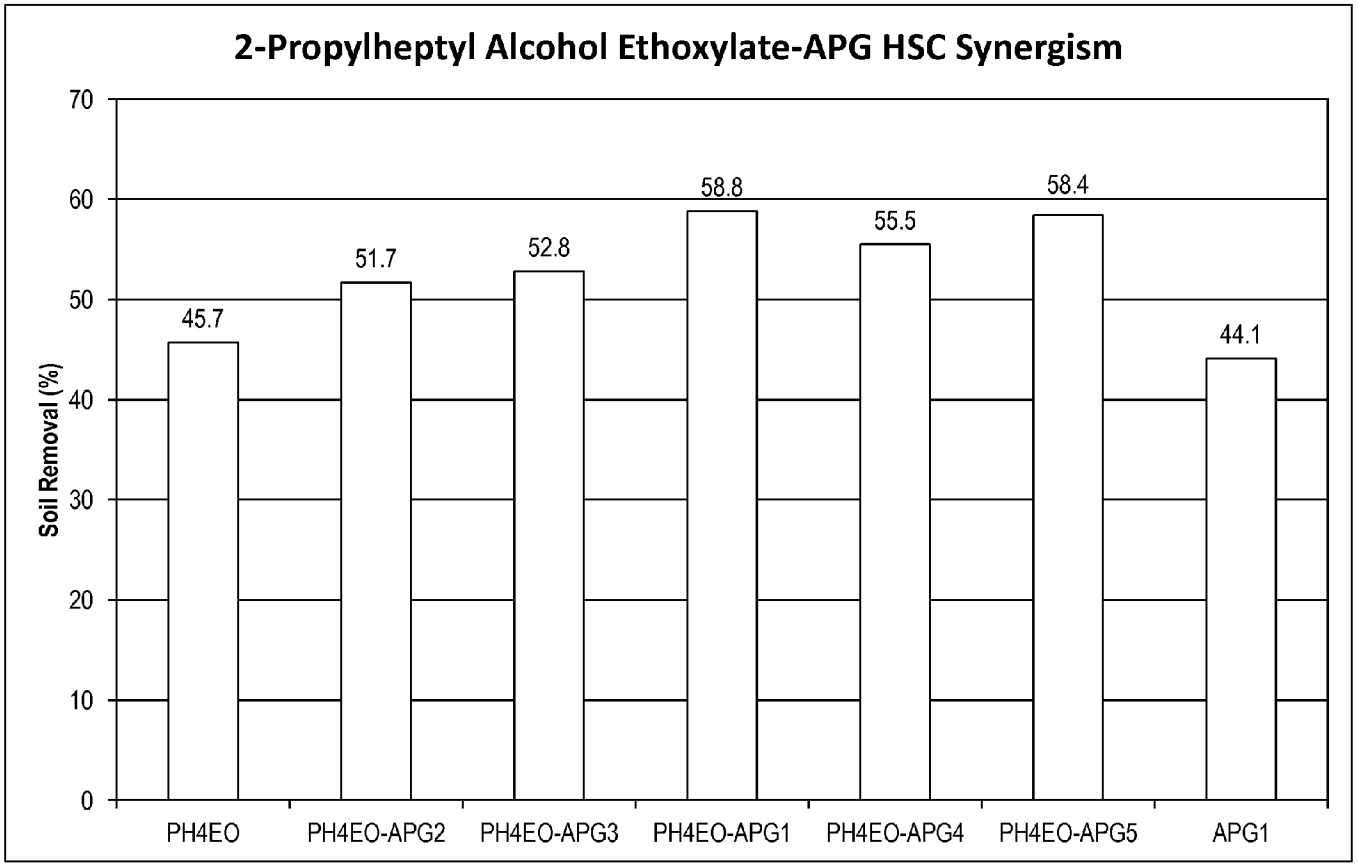
FIG. 6 is a bar graph comparing the soil removal of several compositions according to one or more embodiments of the invention and two comparative examples.

The first composition was a cleaning composition comprising 0.25 weight % of 2-propylheptyl alcohol-4 moles EO, referred to as "PH4EO." PH4EO has an HLB value of 9. This composition is considered to be comparative because it does not contain an alkyl polyglucoside. The seventh composition was the cleaning composition comprising 0.25 weight % of a mixture of $C_{9-11}$ alkyl polyglucosides from Example 1, again referred to as "APG1." This composition is considered a comparative example because it does not contain alkoxylated 2-propylheptanol. The compositions were tested for soil removal according to the same procedures in Example 1. The results of the soil removal are shown in FIG. 6. In FIG. 6, the compounds are listed such that the alkyl polyglucosides are shown in order of decreasing hydrophilicity left to right. As demonstrated in FIG. 6, all mixtures performed better than PH4EO and APG1 alone. It is expected that all of the mixtures would perform better than either the PH4EO alone or its alkyl polyglucoside, as APG1 provides the best hard surface detergency out of the tested alkyl polyglucosides. Therefore, the synergistic effect over PH4EO and APG1 is independent of the alkyl chain lengths of the alkyl polyglucoside.

Example 7

Lack of Synergism with Mixtures Using Low HLB Linear Alcohol Ethoxylates (Comparative)

Six cleaning compositions were prepared and tested for soil removal ability. All compositions contained 0.25 weight % active surfactant, and mixtures of surfactants were in a 1:1 weight ratio. The cleaning compositions were selected as follows in Table 2:

TABLE 2

| | Ethoxylated Alcohol Component | Alkyl Polyglucoside Component |
|---|---|---|
| OD4EO (Comparative) | Blend of n-octyl and n-decyl alcohol ethoxylate with an average of 4 moles of ethoxy groups | None |
| OD4EO-APG3 (1:1) (Comparative) | | a mixture of C8-10 alkyl polyglucosides with avg. DP 1.7 |
| OD4EO-APG1 (1:1) (Comparative) | | a mixture of C9-11 alkyl polyglucosides with avg. DP 1.5 |
| OD4EO-APG4 (1:1) (Comparative) | | a mixture of C8-16 alkyl polyglucosides with avg. DP 1.5 |
| OD4EO-APG5 (1:1) (Comparative) | | a mixture of C12-16 alkyl polyglucosides with avg. DP 1.6 |
| APG1 (Comparative) | None | a mixture of $C_{9-11}$ alkyl polyglucosides with avg. DP 1.5 |

Figure 7:
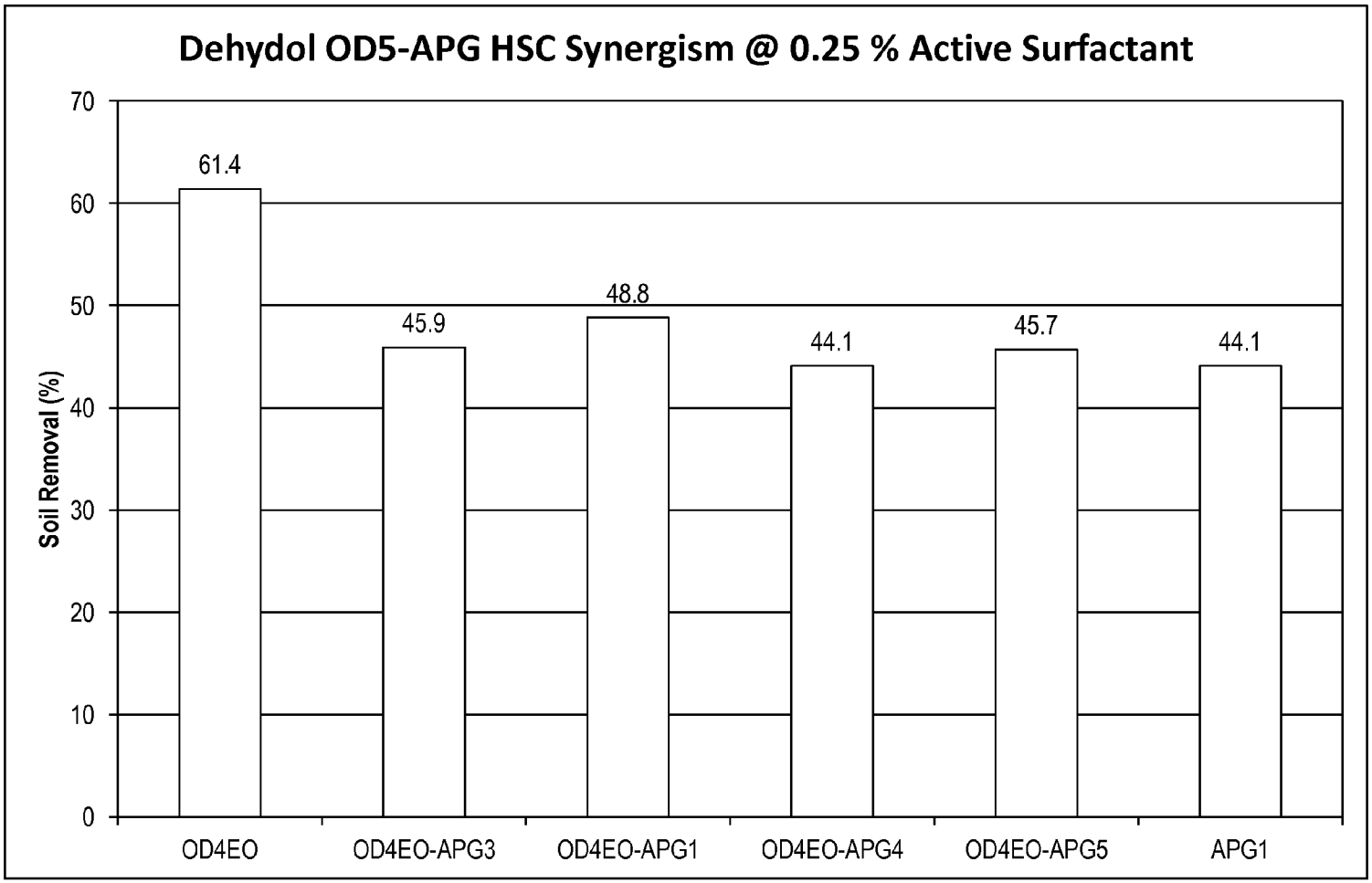
FIG. 7 is a bar graph comparing the soil removal of several comparative compositions.

The first composition was a cleaning composition comprising 0.25 weight % of a blend of n-octyl and n-decyl alcohol-4 moles EO, referred to as "OD4EO." Unlike ethoxylated 2-propylheptyl alcohol, which is branched, OD4EO is based upon a linear fatty alcohol. OD4EO has an HLB value of about 10.6. This composition is considered to be comparative because it contains neither an alkoxylated 2-propyl heptyl alcohol, nor an alkyl polyglucoside. The second through fifth composition are considered comparative because they do not contain an alkoxylated 2-propyl heptyl alcohol, but rather an alkoxylated linear alcohol. The sixth composition was the cleaning composition comprising 0.25 weight % of a mixture of C9-11 alkyl polyglucosides from Example 1, again referred to as "APG1." This composition is considered a comparative example because it does not contain alkoxylated 2-propylheptanol. The compositions were tested for soil removal according to the same procedures in Example 1. The results of the soil removal are shown in FIG. 7. The most soil was removed with the composition containing only OD4EO (61% removal). Furthermore the mixtures of OD4EO with various alkyl polyglucosides did not exhibit much more soil removal than the alkylpolyglucoside by itself. Accordingly, as demonstrated in FIG. 7, the synergistic effect of a mixture comprising an alkoxylated alcohol and alkyl polyglucoside is absent where the alkoxylated alcohol is not based upon the branched 2-propylheptanol.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. A cleaning composition comprising a solution containing one or more alkyl polyglucosides and one or more 2-propylheptanol ethoxylates, wherein the one or more 2-propylheptanol ethoxylates have a hydrophilic-lipophilic balance value that is less than or equal to about 10.5;

wherein the cleaning composition is particle-free, wherein the alkyl polyglucosides and one or more 2-propylheptanol ethoxylates are present in a weight ratio in the range of about 2:1 to 1:2, and wherein the one or more alkyl polyglucosides have an alkyl chain length of 7 to 11 carbon atoms.

2. The cleaning composition of claim 1, wherein the hydrophilic-lipophilic balance value is less than or equal to about 9.

3. The cleaning composition of claim 2, wherein the hydrophilic-lipophilic balance value is less than or equal to about 8.

4. The cleaning composition of claim 1, wherein the one or more alkyl polyglucosides have an alkyl chain length of 8 to 10 carbon atoms.

5. The cleaning composition of claim 1, wherein the one or more alkyl polyglucosides have an alkyl chain length of 9 to 11 carbon atoms.

6. The cleaning composition of claim 1, wherein the one or more 2-propylheptanol ethoxylates comprise the reaction products of about 1 mole 2-propylheptanol with about 3 or 4 moles ethoxylate.

7. The cleaning composition of claim 1, further comprising an additive selected from one or more of a fragrance, a colorant, a foaming agent, an alkaline inorganic builder, a chelating agent, a solvent, a thickener, water, an anionic or cationic or amphoteric polymers, a reducing or oxidizing agent, a hydrotrope, a preservative, a co-surfactant, an inorganic acid, an organic acid, a carbonate, a bicarbonate, a citrate and a gluconate.

8. The cleaning composition of claim 1, wherein the alkyl polyglucoside and 2-propylheptanol ethoxylates are present in a 1:1 weight ratio.

9. The cleaning composition of claim 6, wherein the composition is effective to remove at least 30% more soil than the average of either of the 2-propylheptanol ethoxylates comprising the reaction products of about 1 mole 2-propylheptanol with about 4 moles ethoxylate or the one or more alkyl polyglucosides alone.

10. A method of producing a cleaning composition, the method comprising adding one or more alkyl polyglucosides to one or more 2-propylheptanol ethoxylates to form the cleaning composition, wherein the one or more 2-propylheptanol ethoxylates have a hydrophilic-lipophilic balance value of less than or equal to about 10.5 to a cleaning composition base, wherein the cleaning composition is particle-free, wherein the alkyl polyglucosides and one or more 2-propylheptanol ethoxylates are present in a weight ratio in the range of about 2:1 to 1:2, and wherein the one or more alkyl polyglucosides have an alkyl chain length of 7 to 11 carbon atoms.

11. The method of claim 10, wherein the hydrophilic-lipophilic balance value is less than or equal to about 9.

12. The method of claim 11, wherein the hydrophilic-lipophilic balance value is less than or equal to about 9.

13. The method of claim 10, wherein the one or more alkyl polyglucosides have an alkyl chain length of 8 to 10 carbon atoms.

14. The method of claim 10, wherein the one or more alkyl polyglucosides have an alkyl chain length of 9 to 11 carbon atoms.

15. The method of claim 10, wherein the one or more 2-propylheptanol ethoxylates comprise the reaction product of 1 mole 2-propylheptanol with about 3 or about 4 moles ethoxylate.

16. The method of claim 10, wherein the alkyl polyglucoside and 2-propylheptanol ethoxylates are present in a 1:1 weight ratio.

17. A method of cleaning a hard surface, the method comprising contacting a hard surface with a cleaning composition comprising a solution containing one or more alkyl polyglucosides and one or more 2-propylheptanol ethoxylates, wherein the one or more alkyl polyglucosides and one or more 2-propylheptanol ethoxylates have a hydrophilic-lipophilic balance value of less than or equal to about 10.5, wherein the alkyl polyglucosides and one or more 2-propylheptanol ethoxylates are present in a weight ratio in the range of about 2:1 to 1:2, and wherein the one or more alkyl polyglucosides have an alkyl chain length of 7 to 11 carbon atoms.

18. The method of claim 17, wherein the alkyl polyglucoside and 2-propylheptanol ethoxylates are present in a 1:1 weight ratio.

19. The method of claim 17, wherein the one or more alkyl polyglucosides have an alkyl chain length of 8 to 10 carbon atoms.

* * * * *